United States Patent [19]

Ikkatai et al.

[11] Patent Number: 5,012,295

[45] Date of Patent: Apr. 30, 1991

[54] SHEET PROCESSING DEVICE AND IMAGE RECORDING APPARATUS USING THE SAME

[75] Inventors: Masatoshi Ikkatai, Kawasaki; Atsutomo Yoshizawa, Tokyo; Toshio Honma, Kawasaki, all of Japan

[73] Assignee: Canon Kabushiki Kaisha, Tokyo, Japan

[21] Appl. No.: 522,454

[22] Filed: May 14, 1990

Related U.S. Application Data

[63] Continuation of Ser. No. 216,425, Jul. 8, 1988, abandoned.

[30] Foreign Application Priority Data

Jul. 13, 1987 [JP] Japan ..... 62-106373[U]
Jul. 13, 1987 [JP] Japan ..... 62-106374[U]
Jul. 13, 1987 [JP] Japan ..... 62-173046

[51] Int. Cl.[5] ..... G03G 15/00
[52] U.S. Cl. ..... 355/311; 271/207
[58] Field of Search ..... 355/309–311; 242/DIG. 3; 400/614, 614.1; 271/207

[56] References Cited

U.S. PATENT DOCUMENTS

| | | | |
|---|---|---|---|
| 2,494,129 | 1/1950 | Holton, Sr. | 226/187 X |
| 3,514,204 | 5/1970 | Trombetta | 355/14 |
| 3,807,726 | 4/1974 | Hope et al. | 271/207 |
| 3,865,481 | 2/1975 | Washio et al. | 355/29 X |
| 3,944,207 | 3/1976 | Bains | 270/58 |
| 3,992,082 | 11/1975 | Cavallaro et al. | 355/3 R |
| 4,720,728 | 1/1988 | Kando | 355/309 |
| 4,783,683 | 11/1988 | Nagumo et al. | 355/27 |
| 4,784,345 | 11/1988 | Romanowski et al. | 242/DIG. 3 |
| 4,804,174 | 2/1989 | Ler Horst | 271/207 |

FOREIGN PATENT DOCUMENTS

| | | | |
|---|---|---|---|
| 0018786 | 11/1980 | European Pat. Off. . | |
| 1145813 | 9/1969 | Fed. Rep. of Germany . | |
| 1925440 | 11/1969 | Fed. Rep. of Germany . | |
| 2158090 | 6/1973 | Fed. Rep. of Germany . | |
| 2456014 | 6/1975 | Fed. Rep. of Germany . | |
| 3529981 | 2/1987 | Fed. Rep. of Germany . | |
| 60-36261 | 2/1985 | Japan | 271/207 |
| 62-31658 | 2/1987 | Japan . | |
| 63-161383 | 1/1988 | Japan | 271/207 |
| 1231214 | 5/1971 | United Kingdom | 242/DIG. 3 |
| 1464262 | 2/1977 | United Kingdom . | |

*Primary Examiner*—A. A. Mathews
*Assistant Examiner*—D. Rutledge
*Attorney, Agent, or Firm*—Fitzpatrick, Cella, Harper & Scinto

[57] ABSTRACT

An image recording apparatus for recording an image on a recording sheet, includes a recording section for recording an image on the recording sheet, a recording sheet holding section for holding the recording sheet, a conveying section for conveying the recording sheet held by the recording sheet holding section to a recording operation position by the recording section, a guide section for guiding the recording sheet to a convey path according to a size of the recording sheet subjected to the recording operation by the recording section, a first size recording sheet receiving section for receiving a first size recording sheet guided by the guide section, and a second size recording sheet receiving section for receiving a second size recording sheet different from the first size recording sheet and guided by the guide section.

29 Claims, 11 Drawing Sheets

SHEET PROCESSING DEVICE AND IMAGE RECORDING APPARATUS USING THE SAME

This application is a continuation of application Ser. No. 216,425 filed July 8, 1988, now abandoned.

BACKGROUND OF THE INVENTION

1. Field of the Invention

The present invention relates to a sheet processing device which can process a recording sheet used in an image recording apparatus such as a copying machine, printer, or the like, and to an image recording apparatus using the sheet processing device.

The image recording apparatus includes a copying machine, a printer, a facsimile apparatus, or the like. The recording sheet includes normal paper, processed paper, an OHP plastic sheet, or the like.

2. Related Background Art

In a conventional copying machine, printer, or the like, a tray capable of storing maximum size recording sheets in the machine is arranged behind a pair of paper exhaust guides. The recording sheet is conveyed by a pair of paper exhaust rollers so as to be stored in the tray.

However, since a tray matching with the recording sheet must be provided in the conventional apparatus, (1) it is difficult to form a tray for an elongate recording sheet exceeding an A1 size or a wide space must be kept around the machine; (2) the recording sheet may be damaged or bent; (3) when recording sheets exceeding the A1 size and B5 or A4 size recording sheets are stored in a single tray, it is difficult to take out a smaller size recording sheet from the tray; (4) when a recording sheet is manually wound, a user must attend to the machine until the recording sheet is completely exhausted; and (5) when a large number of elongate papers exceeding the A1 size are continuously recorded, it is difficult to store these recording sheets.

SUMMARY OF THE INVENTION

It is an object of the present invention to provide a sheet processing device capable of satisfactorily processing both large and small size recording sheets and an image recording apparatus using the sheet processing device.

It is another object of the present invention to provide a sheet processing device capable of storing both large and small size recording sheets and an image recording apparatus using the sheet processing device.

It is still another object of the present invention to provide a sheet processing device capable of processing both large and small size recording sheets in a small space and an image recording apparatus using the sheet processing device.

It is still another object of the present invention to provide a sheet processing device which can wind up a recording sheet on which an image is recorded and which is exhausted by paper exhaust rollers, as needed, and an image recording apparatus using the sheet processing device.

It is still another object of the present invention to provide a sheet processing device capable of automatically and smoothly processing both large and small size recording sheets and an image recording apparatus using the sheet processing device.

It is still another object of the present invention to provide a sheet processing device which can wind up a leading end of a large size recording sheet so as to store the sheet in a small space and an image recording apparatus using the sheet processing device.

DETAILED DESCRIPTION OF THE PREFERRED EMBODIMENTS

An embodiment of a sheet processing device to which the present invention is applied will be described hereinafter with reference to the accompanying drawings.

Figure 1:
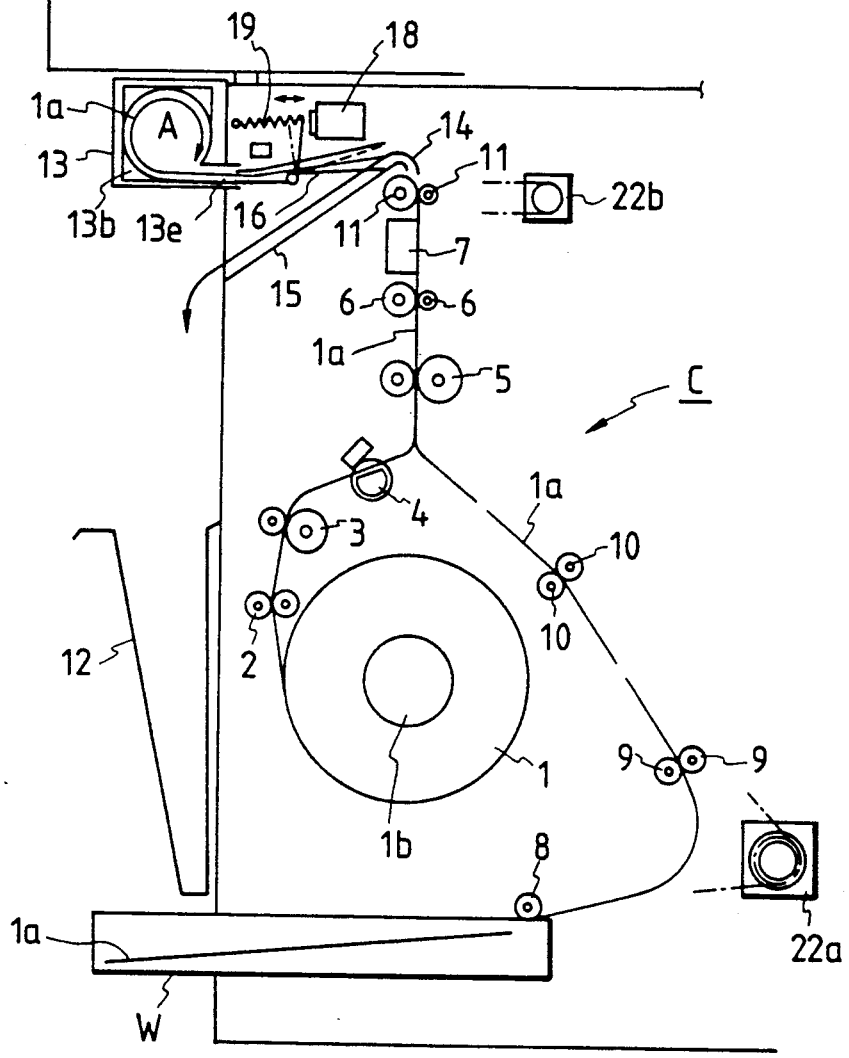
FIG. 1 is a sectional view showing a main portion of the overall device according to the present invention.
Figure 2:
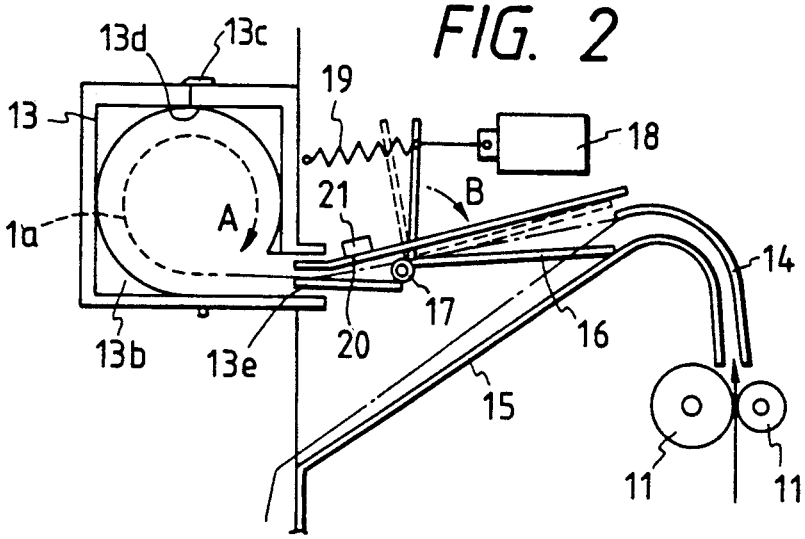
FIG. 2 is an enlarged view for explaining the main portion.
Figure 3:
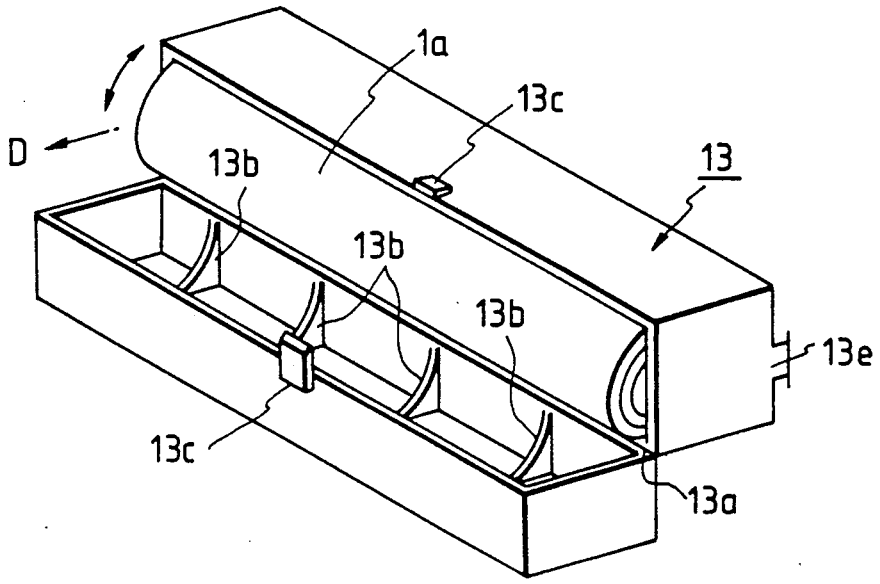
FIG. 3 is a perspective view of the portion shown in FIG. 2.
Figure 4:
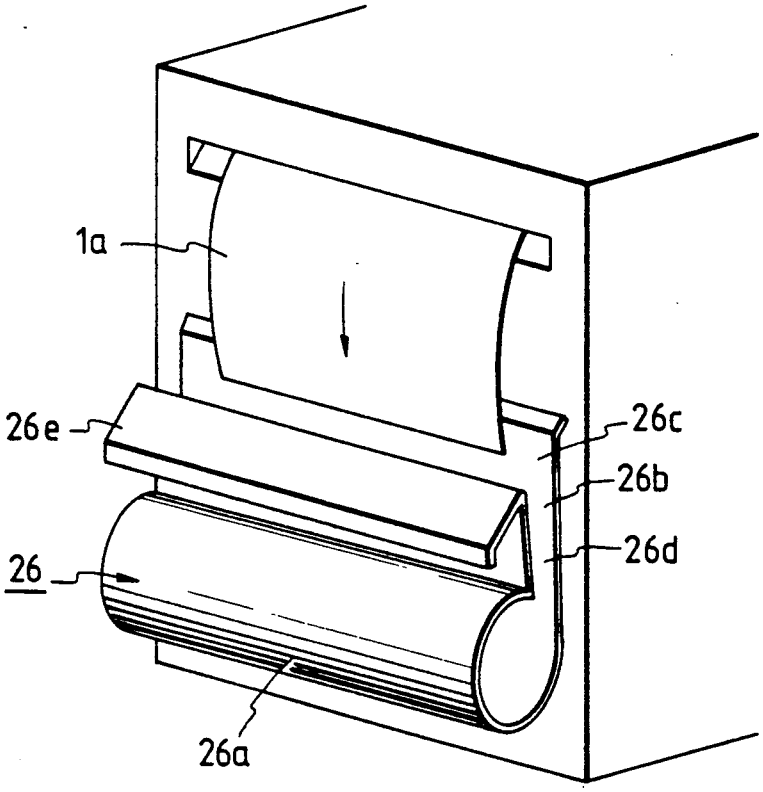
FIG. 4, FIGS. 5A to 5E, and FIGS. 6A to 6F are views for explaining other embodiments.
Figure 6A:
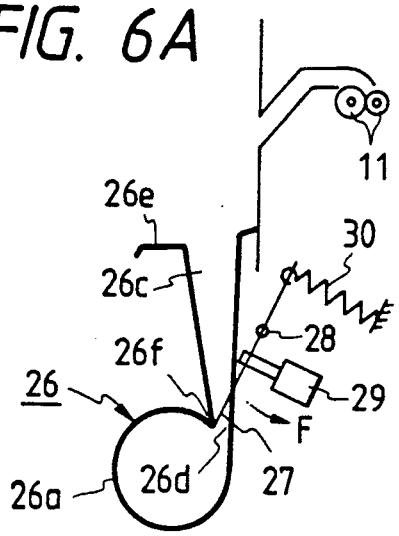
Figure 6B:
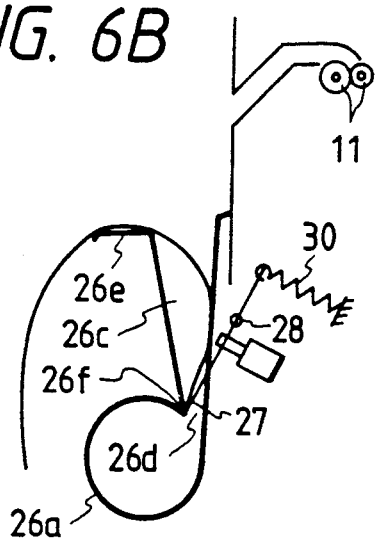
Figure 6C:
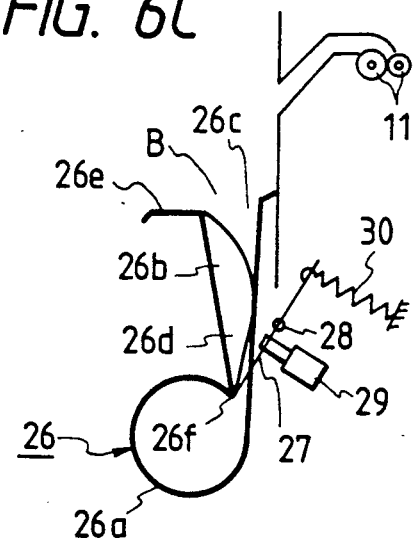
Figure 6D:
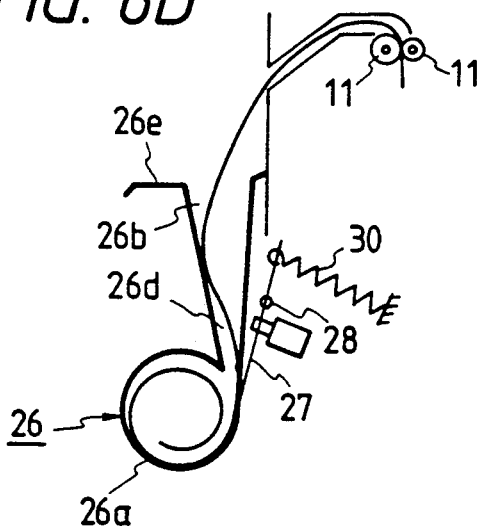
Figure 6E:
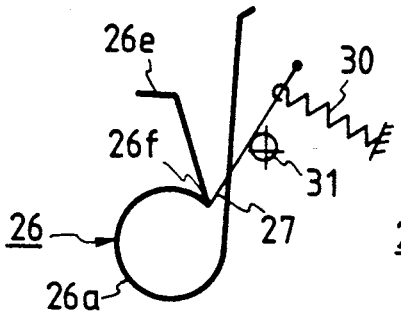
Figure 6F:
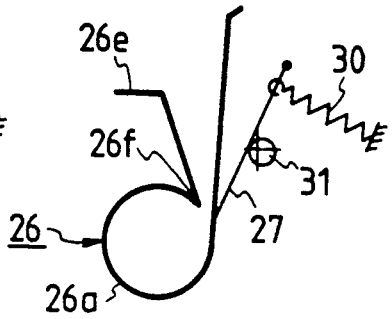
Figure 7:
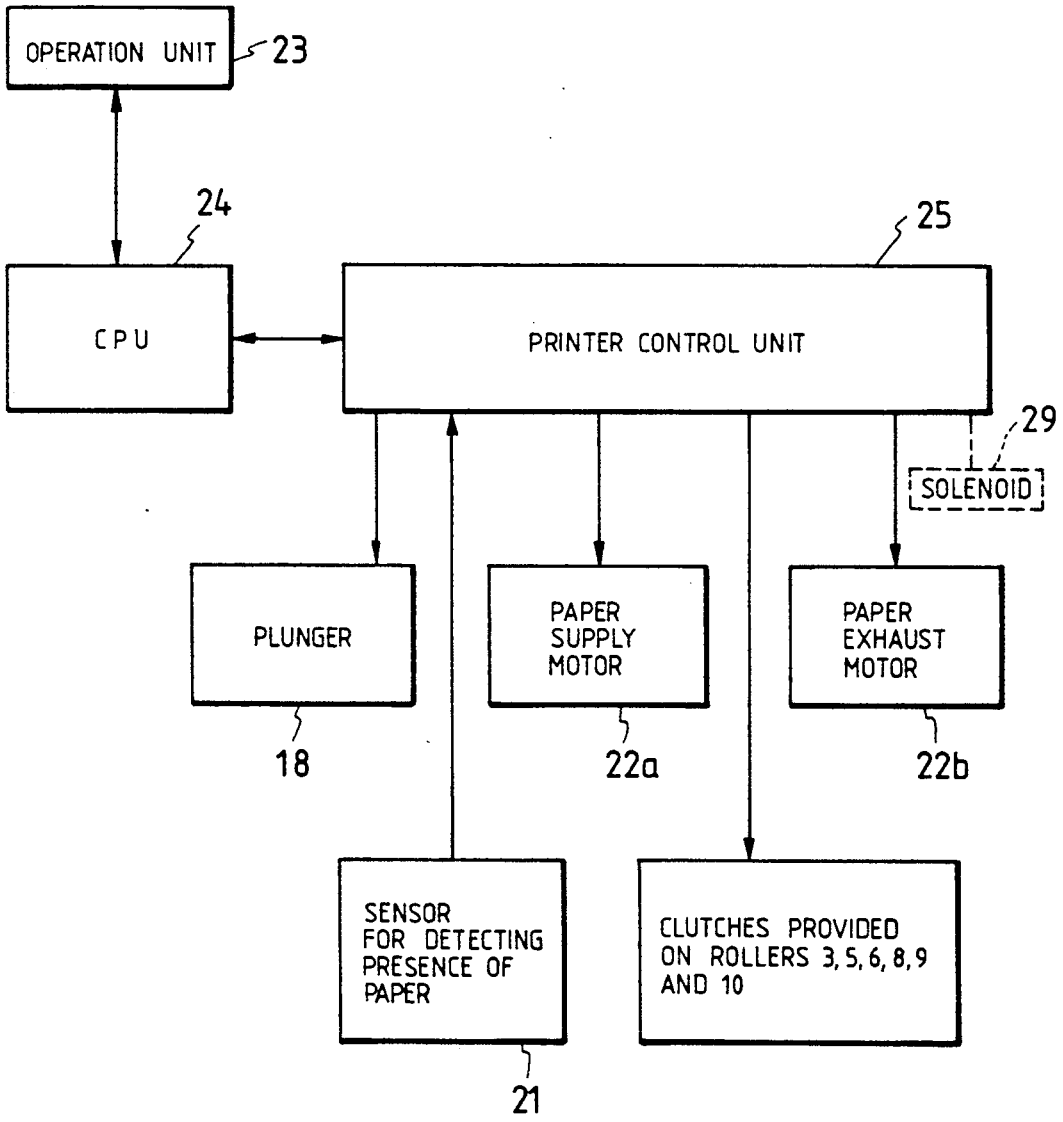
FIG. 7 is a block diagram showing control of the device of the present invention.
Figure 8:
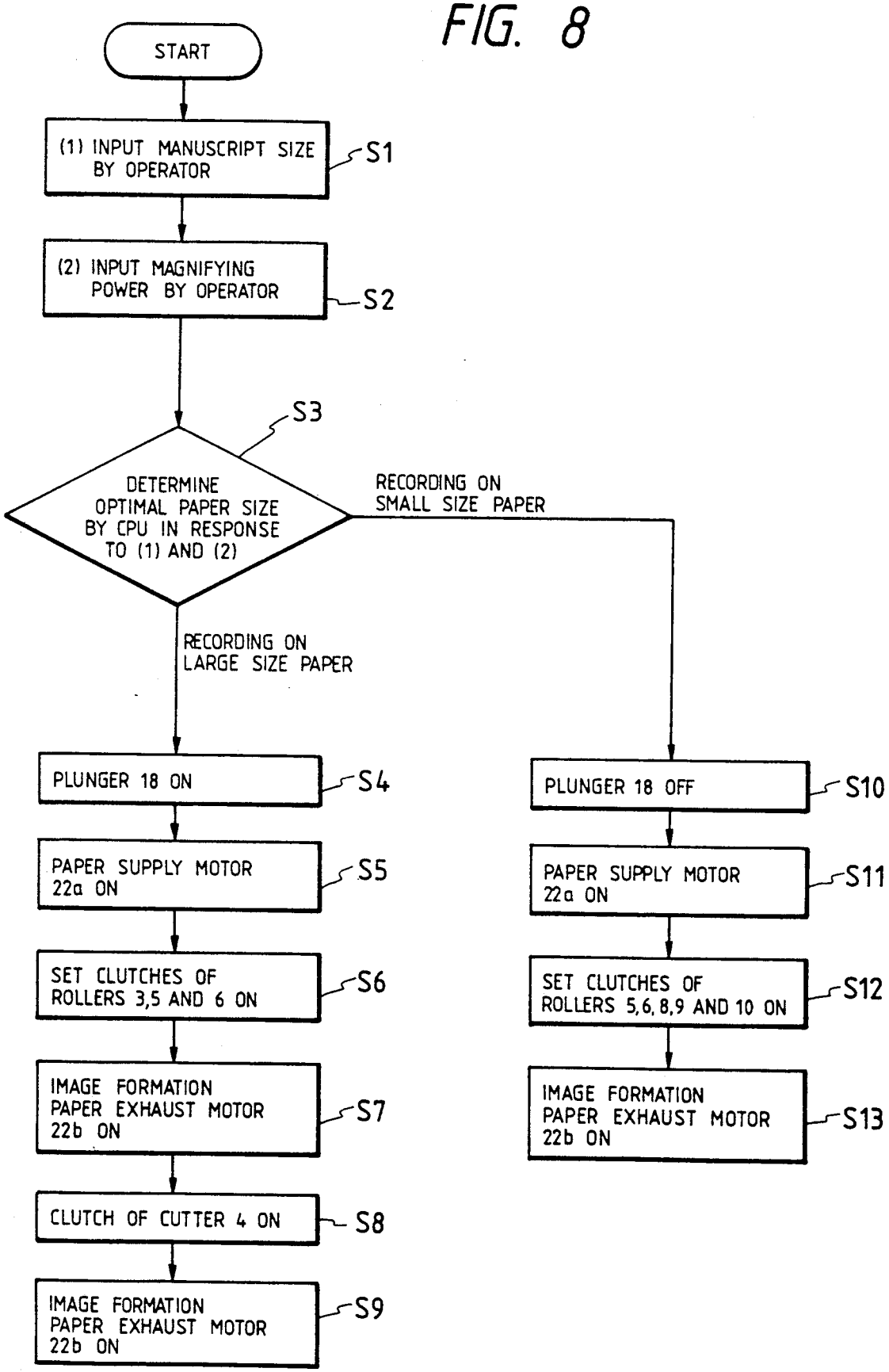
FIGS. 8 and 9 are flow charts showing an operation of the device of the present invention.
Figure 9:
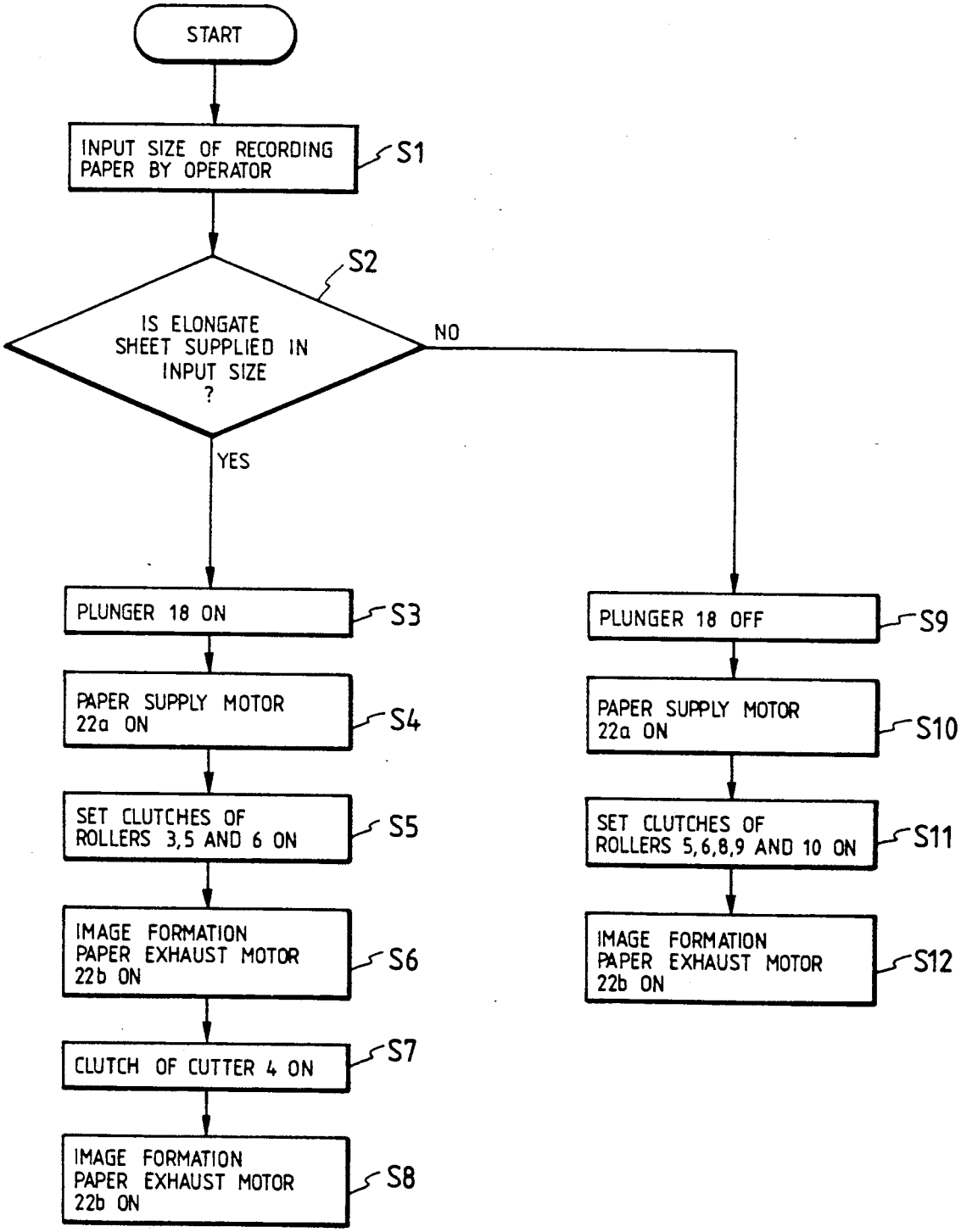

FIG. 1 is a sectional view showing a main portion of the overall device according to the present invention, FIG. 2 is an enlarged view for explaining the main portion, FIG. 3 is a perspective view of the portion shown in FIG. 2, FIG. 4, FIGS. 5A to 5E, and FIGS. 6A to 6F are views for explaining other embodiments, FIG. 7 is a block diagram showing control of the device of the present invention, and FIGS. 8 and 9 are flow charts showing an operation of the device of the present invention.

In FIGS. 1 to 3, an elongate recording sheet 1 is wound up in a roll shape. The recording sheet 1 passes between guide rollers 2 and paper supply rollers 3, and is cut by a cutter 4 into a cut recording sheet 1*a* having a predetermined length. Thereafter, the sheet 1*a* is conveyed to an image forming unit 7 by convey rollers 5 and 6. The sheet 1*a* stored in a box-like cut sheet storing unit W (e.g., a cassette detachable with an apparatus body C) is a cut recording sheet which is cut into a predetermined size in advance. The sheet 1*a* is conveyed to the image forming unit 7 through a cut recording sheet supply roller 8, convey rollers 9 and 10, and the convey rollers 5 and 6. A pair of paper exhaust rollers 11 can feed the cut recording sheet 1*a* on which an image is formed by the image forming unit 7 (e.g., employing an ink-jet recording method, an electrophotographic method, a thermal recording method, or the like) to a tray 12 or a large size sheet wind-up box 13 which can wind up the sheet while moving the sheet in a direction indicated by an arrow A. Note that the wind-up box 13 can be open about a hinge 13*a* by releasing a hook 13*c* (FIG. 3), and the recording sheet stored therein can be easily taken out. A paper exhaust guide 14 and a paper exhaust tray guide 15 are arranged adjacent to the paper exhaust rollers 11. An L-shaped swingable guide 16 is swung about a swinging shaft 17 as the fulcrum, so that its horizontal distal end can be brought into contact with or separated from the surface of the paper exhaust tray guide 15. The swingable guide 16 can be operated by a plunger 18 and a return spring 19. An elongate guide 20 guides the large size recording sheet 1a to the large size sheet wind-up box 13. A sensor 21 detects the presence/absence of the recording sheet.

The wind-up box 13 can be opened/closed through the hinge 13a, as shown in FIG. 3. An inner peripheral portion 13d of the box 13 is formed into an arcuated shape so that the recording sheet 1a can be wound up while being curled and moved in a direction of the arrow A, as shown in FIGS. 2 and 3. An introduction port 13e for introducing the recording sheet 1a is provided to a lower side portion of the wind-up box 13. As can be seen from FIG. 3, the wind-up box 13 can be desirably opened/closed through the hinge 13a, and has, on the inner peripheral portion 13d, a guide rib 13b having a plurality of arcuated inner surfaces capable of winding up the recording sheet 1a while curling it. The recording sheet 1a wound up in the wind-up box 13 can be drawn out and taken out in a direction of an arrow D by opening the wind-up box 13.

The paper supply rollers 3, the cutter 4, the convey rollers 5 and 6, the cut recording sheet supply roller 8, and the convey rollers 9 and 10 incorporate clutch mechanisms (not shown), respectively.

A paper supply motor 22a in FIG. 1 serves as a drive source of the paper supply rollers 3, the cutter 4, the convey rollers 5, 6, 9, and 10, and the paper supply roller 8. A paper exhaust motor 22b serves as a drive source for the paper exhaust rollers 11.

The operation of the device will be described hereinafter.

The size of the elongate recording sheet 1 wound up in a roll is set by turning on, e.g., an operation button (not shown) on an operation unit 23. When a large size exceeding a so-called A1 size is selected, the plunger 18 is turned on, and the swingable guide 16 is moved about the swinging shaft 17 in the direction of the arrow B. Thus, the horizontal distal end of the guide 16 is brought into contact with the surface of the paper exhaust tray guide 15. Thus, preparation for introducing the large size recording sheet 1a fed from the paper exhaust rollers 11 into the wind-up box 13 is completed. The elongate recording sheet 1 drawn out from the roll 1b or the large size recording sheet 1a fed from the storing unit W is fed to the image forming unit 7 through the convey rollers 5 and 6. After an image is formed on the sheet, the sheet is exhausted by the paper exhaust rollers 11. The sheet passes through the paper exhaust guide 14, the swingable guide 16, and the elongate guide 20, and is then introduced into the wind-up box 13. In the wind-up box 13, the sheet is automatically wound up while being in contact with the guide rib 13b. The large size recording sheets 1a sequentially introduced into the wind-up box 13 are concentrically wound up by the convey force of the rollers 11 and the like, as shown in FIG. 3. Note that the elongate recording sheet 1 is cut by the cutter 4 after the image is formed thereon by the image forming unit 7. When the trailing end of the recording sheet 1a leaves the paper exhaust rollers 11, the movement of the recording sheet 1a is stopped. When the sensor 21 is turned on, the next operation is not performed. The user takes out the recording sheet 1a from the wind-up box 13 in the direction of the arrow D (FIG. 3), thus turning off the sensor 21. Thus, the next operation can be performed.

When the size of the recording sheet 1a is selected to be a size smaller than the A1 size, the plunger 18 is kept OFF, and the swingable guide 16 is held at a normal position at which its horizontal distal end is separated from the surface of the paper exhaust tray guide 15. The recording sheet 1a of a size smaller than the A1 size obtained by cutting the elongate recording sheet 1 exhausted by the paper exhaust rollers 11 or the recording sheet 1a of a size smaller than the A1 size stored in the storing unit W as a cut sheet and fed from the storing unit W passes through the paper exhaust guide 14 and the paper exhaust tray guide 15 and is dropped onto and stacked on the paper exhaust tray 12.

An ON/OFF controlling method of the plunger 18 in recording using a large size recording sheet and recording using a small size recording sheet will be described hereinafter with reference to FIGS. 7 and 8.

FIG. 7 is a block diagram of control of the recording apparatus (printer) C. The operation unit 23 is a means for inputting a manuscript size, a magnifying power, a recording count, and the like. A CPU 24 determines an optimal paper size based on data input from the operation unit 23, and sends the size data to a printer control unit 25. Based on the optimal paper size data sent from the CPU 24, the printer control unit 25 controls the plunger 18, the paper supply motor 22a, the paper exhaust motor 22b, the sensor 21, the clutches provided to the rollers 3, 5, 6, 8, 9, and 10, and the like. When the optimal paper size of the recording sheet corresponds to a large size (in this embodiment, A1 size or larger), the plunger 18 is turned on in response to a signal from the printer control unit 25. When the optimal paper size corresponds to a small size (e.g., less than A1 size), the ON signal is not generated, and the plunger 18 is kept OFF.

The control sequence will be described hereinafter with reference to the flow charts shown in FIGS. 8 and 9 and FIGS. 1 and 2.

In step S1, an operator inputs a manuscript size at the operation unit 23. Instep S2, an equal, enlargement, or reduction magnifying power is input at the operation unit 23, and the flow advances to step S3.

In step S3, the CPU 24 determines the optimal paper size based on the input data. If the optimal paper size corresponds to recording on large size paper, the flow advances to step S4. If the optimal paper size corresponds to recording on small size paper, the flow advances to step S10.

In step S4, the plunger 18 is turned on, and the swingable guide 16 is moved about the swinging shaft 17 in the direction of the arrow B. The flow then advances to step S5.

In step S5, the paper supply motor 22a starts rotation, and transmits power through a chain (not shown). In step S6, the clutches provided to the rollers 3, 5, and 6 are respectively turned on, thereby rotating the rollers 3, 5, and 6. Thus, the recording sheet 1 is fed to the image forming unit 7.

In step S7, image recording is performed on the recording sheet 1 by the image forming unit 7. After image formation, the recording sheet 1 is exhausted by the paper exhaust rollers 11. Note that the image forming unit 7 records an image in accordance with an image signal according to an image read by a manuscript image recording apparatus (not shown) attached to the recording apparatus C or an image signal sent from other apparatuses. In step S8, when the recording sheet 1 is fed by a predetermined length, the clutch accommodated in the cutter 4 is turned on to operate the cutter. Thus, the recording sheet 1 is cut at the rear end portion of the recorded image into the elongate recording sheet 1a. In step S9, the sheet 1a is exhausted by the paper exhaust motor 22b.

Thereafter, the recording sheet 1a is introduced into the wind-up box 13 through the paper exhaust guide 14, the swingable guide 16, and the elongate guide 20. The sheet 1a is naturally wound up by the conveying force of the rollers 11 and the like while being in contact with the guide rib 13b.

When the optimal paper size of the recording sheet corresponds to a small size, the plunger 18 is kept OFF in step S10, and the swingable guide 16 is held at the normal position by the return spring 19.

In step S11, in order to feed a small size sheet, the paper supply motor 22a is turned on, and the flow advances to step S12.

In step S12, the rollers 8, 9, 10, 5, and 6 are turned on, and the small size recording sheet 1a supplied from the storing unit W is fed to the image forming unit 7. An image is formed on the sheet 1a by the image forming unit 7, and the flow advances to step S13.

In step S13, the paper exhaust motor 22b is turned on, and the sheet is exhausted by the paper exhaust rollers 11. The exhausted sheet is stored in the tray 12 via the paper exhaust guide 14 and the paper exhaust tray guide 15.

In the above description, the small size recording sheet 1a is fed from the storing unit W. However, if the small size recording sheet 1a obtained by cutting the recording sheet roll 1 into a small size is used, the plunger 18 is moved in the same manner as described above.

In the flow chart shown in FIG. 8, the user inputs a manuscript size and a magnifying power at the operation unit 23, and the CPU determines the size of the recording sheet. In contrast to this, the user can input whether a cut sheet or an elongate sheet roll is used as a recording sheet. When the cut sheet mode is selected, the plunger 18 may be controlled to exhaust the sheet onto the paper exhaust tray 12. When a large size recording mode using an elongate sheet is selected, the plunger 18 may be controlled to exhaust the cut sheet 1a into the wind-up box 13.

This case will be described below with reference to the flow chart shown in FIG. 9. When the user inputs a size of a recording sheet to be used at the operation unit 23 in step S1, the CPU 24 checks based on the input size in step S2 whether an elongate recording sheet or a cut sheet is to be supplied.

If it is determined that the elongate sheetis to be supplied, the flow advances to step S3. On the other hand, if it is determined that the cut sheet is to be supplied, the flow advances to step S9.

In step S3, the plunger 18 is turned on, and thereafter, the swingable guide 16 is pivoted about the swinging shaft 17 in the direction of the arrow B and its horizontal distal end is brought into contact with the surface of the paper exhaust tray guide 15 through steps S4 to S8 in the same manner as described with reference to the flow chart of FIG. 8. When the cut recording sheet is to be supplied, the plunger 18 is kept OFF in step S9, and the swingable guide 16 is held at the normal position by the return spring 19. Thereafter, the large size recording sheet 1a is introduced into the wind-up box 13 through steps S10 to S12 in the same manner as in the case wherein the user inputs the manuscript size and the magnifying power. When the cut recording sheet is used, the sheet is dropped on and stored in the paper exhaust tray 12 via the paper exhaust tray guide 15 of the paper exhaust guide 14.

In this embodiment, the large size recording sheet 1a obtained by cutting the elongate recording sheet 1 is stored while being wound up in the wind-up box 13. The small size recording sheet 1a is stored in the separate small size tray 12. However, the large and small size recording sheets 1a can be stored in a common storing tray, as will be described below.

Figure 5A:
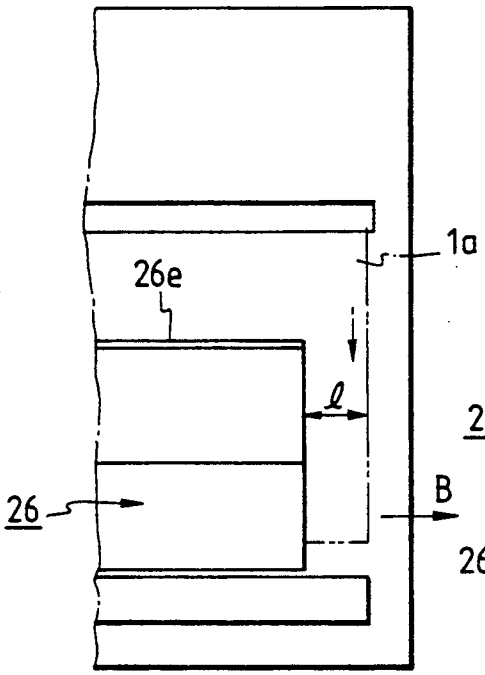
Figure 5B:
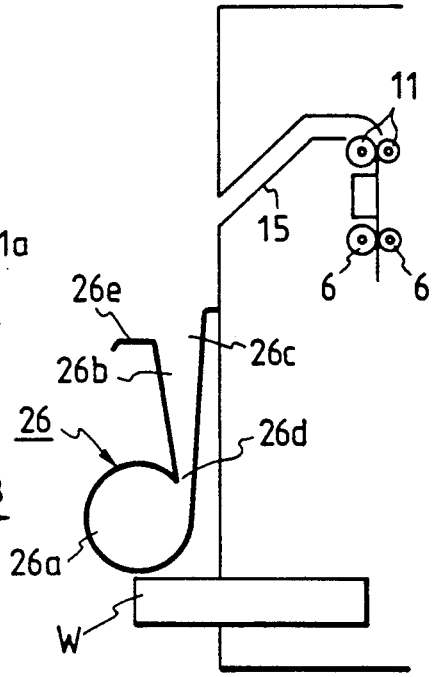

In FIG. 4 and FIGS. 5A to 5E, a common tray 26 is arranged to store both a large size recording sheet 1a equal to or larger than an A1 size or a small size recording sheet 1a smaller than the A1 size. An inner bottom portion 26a of the common tray 26 has an arcuated shape, so that the large size recording sheet 1a can be automatically curled and wound up. An entrance portion 26c of an upper portion 26b of the common tray 26 has a narrowed portion 26d which is large enough for the leading end of the recording sheet 1a supplied along the paper exhaust tray guide 15 to be dropped into the arcuated inner bottom portion 26a. The recording sheet 1a introduced from the narrowed portion 26d into the inner bottom portion 26a can be automatically curled. Note that FIG. 5A is a front view showing the main part of the device of this embodiment, and FIGS. 5B to 5E are sectional views thereof.

Figure 5C:
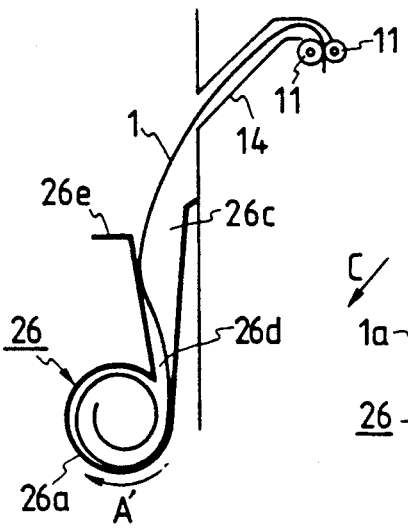
Figure 5D:
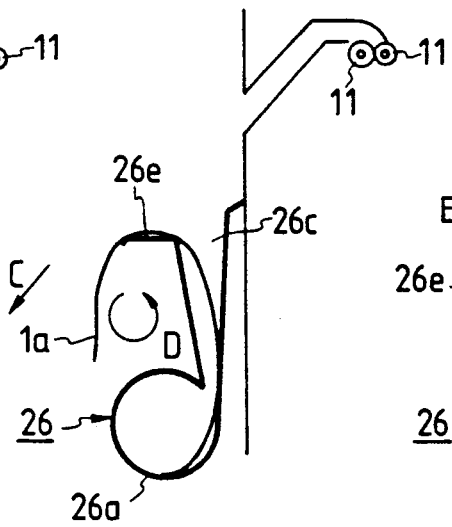

Therefore, in this embodiment, when the non-cut recording sheet 1 is selected, the recording sheet 1 exhausted by the paper exhaust rollers 11 is guided into the inner bottom portion 26a from the narrowed portion 26d of the entrance portion 26c of the common tray 26, and is gradually wound up in a direction of an arrow A' by a push-out force of the paper exhaust rollers 11, as shown in FIG. 5C. Thereafter, the trailing end of the cut recording sheet 1 is supported at a terrace portion 26e of the entrance portion 26c of the tray 26, as shown in FIG. 5D.

A case will be described below wherein the recording sheet 1a as a cut sheet is used. Among the recording sheets 1a, a leading end portion of a large size recording sheet 1a larger than the A1 size is slightly curled by the inner bottom portion 26a, and thereafter, a portion near its trailing end is supported by the entrance terrace portion 26e of the common tray 26, as shown in FIG. 5D, thus completing a paper exhaust operation. On the other hand, a small size recording sheet 1a is almost entirely stored in the tray 26, as shown in FIG. 5D, thus completing the paper exhaust operation.

Figure 5E:
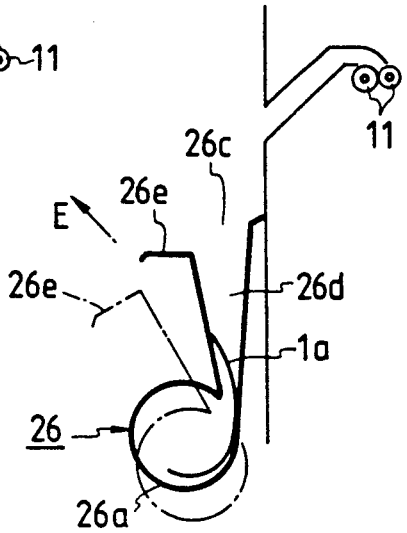

When a recording sheet stored in the tray 26 is taken out, the trailing ends of the elongate recording sheet 1 and the large size recording sheet 1a are exposed from the tray 26. Therefore, these sheets can be pulled in a direction of an arrow C in FIG. 5D or can be taken out while being wound up in a direction of an arrow D. In the case of the small size recording sheet 1a, if a one-side reference machine is used, the width of the reference side is shortened by a given amount l, so that the recording sheet 1a can be drawn out in the direction of the arrow B. If a center-reference machine is used, the tray 26 having a small width can be used, so that the recording sheet 1a is exposed from both sides of the tray 26. Thus, the recording sheet 1a can be drawn out in either direction. As shown in FIG. 5E, the terrace portion 26e of the tray 26 can be pulled to widen the entrance portion 26c of the tray 26. Thus, the trailing end of the recording sheet can be pulled in a direction of an arrow E, and can be easily taken out.

An embodiment shown in FIGS. 6A to 6F is an improvement of the embodiment shown in FIGS. 5A to 5E.

In this embodiment, a partition plate 27 is mounted on the narrowed portion 26*d* of the entrance portion 26*c* of the common tray 26 to be pivotal about a fulcrum 28 by a solenoid 29. The distal end of the partition plate 27 is biased against a surface 26*f* opposing the narrowed portion by the tension of a spring 30. With this arrangement, the entrance of the arcuated inner bottom portion 26*a* of the tray 26 is closed. Therefore, the partition plate 27 is pivoted in a direction of an arrow F in FIG. 6A against the tension of the spring 30 upon turning on of the solenoid 29 and opens the entrance portion of the inner bottom portion 26*a*. In this manner, the recording sheet is allowed to pass through the entrance portion.

In this embodiment, when a small size recording sheet 1*a* as a cut sheet is selected, the solenoid 29 is kept off, and the partition plate 27 closes the entrance portion of the inner bottom portion 26*a* of the tray 26. The exhausted small size recording sheet 1*a* is not inserted in the inner bottom portion 26*a*, and is supported at the entrance portion 26*c* or the terrace portion 26*e*, as shown in FIGS. 6B and 6C, thus completing a paper exhaust operation.

When the large size recording sheet 1*a* is selected, as shown in FIG. 6D, the solenoid 29 is turned on, and the partition plate 27 opens the entrance portion of the inner bottom portion 26*a*. The leading end of the recording sheet 1*a* is inserted in the inner bottom portion 26*a*, and is wound up while being curled. In this manner, the recording sheet 1 can be exhausted.

As shown in FIGS. 6E and 6F, a cam 31 is used in place of the solenoid 29. The cam 31 is rotated through 180° by a drive source (not shown), so that the partition plate 27 can be operated in the same manner as in the case using the solenoid 29. Note that the solenoid 29 is controlled by the printer control unit 25 described above.

In the above embodiment, the large and small size recording sheets 1*a* are classified with reference to the A1 size. However, the reference size can be changed as needed.

Note that the large size recording sheets 1*a* include an extremely long large size sheet 1*a* which is obtained such that the leading end portion of the elongate recording sheet 1 is wound up in the wind-up box 13 or the common tray 26 and thereafter, is cut into a predetermined length by the cutter 4, a large size recording sheet 1*a*, the trailing end portion of which is cut by the cutter 4 before its leading end portion reaches the wind-up box 13 or the common tray 26, and a normally large size recording sheet which is supplied as a cut sheet in advance.

The device according to the present invention has a wind-up storing unit capable of storing a large size recording sheet while winding it up. Therefore, no large tray is necessary unlike in the conventional device, and a recording sheet exhausted from a paper exhaust unit can be processed in a small storing space. In addition, large and small size recording sheets can be smoothly stored, and hence, the recording sheet can be prevented from being damaged, bent, and so on. Furthermore, the stored recording sheet can be smoothly taken out, and can be automatically processed even if a user leaves the apparatus.

Another embodiment of a sheet wind-up storing device will be described below.

Figure 10A:
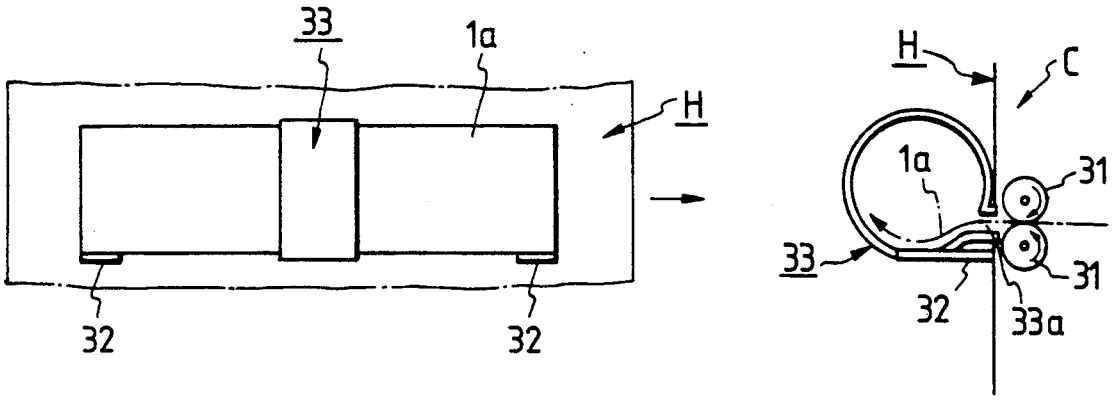
FIGS. 10A, 10B, FIGS. 11A to 11C, FIG. 12, and FIGS. 13A and 13B are views for explaining other embodiments of a sheet wind-up storing device according to the present invention.
Figure 10B:
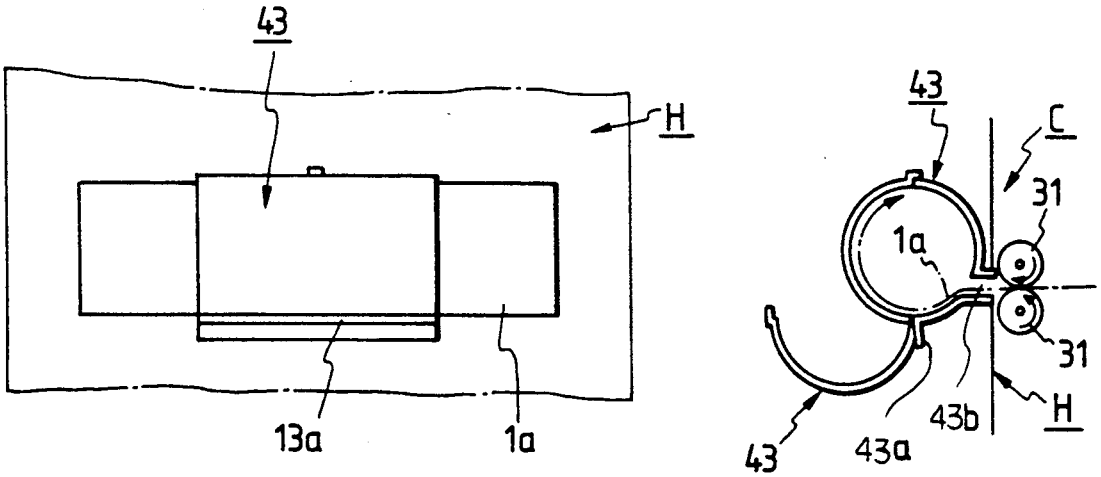

In the above embodiment, the wind-up box 13 is arranged to have a closed box shape. However, the wind-up box may be arranged to be an open wind-up box 33 as shown in FIGS. 10A and 10B. In FIG. 10A, the wind-up box 33 is constituted by a cylinder having a small width. The wind-up box 33 is arranged such that a large size recording sheet 1*a* supplied by paper exhaust rollers 31 provided to a frame H of a main body C can be introduced from its introduction port 33*a* to be wound up. A guide support plate 32 is arranged to support the two sides of the recording sheet 1*a*.

A portion of a wind-up box shown in FIG. 10B is arranged to be freely opened/closed through a flange 43*a*.

In the case of the embodiment shown in FIG. 10A, since the two side surfaces of the wind-up box 33 are open, the recording sheet 1*a* wound in the box 33 can be taken out in either the left or right direction. In the case of FIG. 10B, a portion of the wind-up box 43 can be opened through the flange 43*a*, so that the wound-up recording sheet 1*a* can be taken out from the opening. Note that 43*b* indicates an introduction port.

In the above embodiments, each of the wind-up boxes 33 and 43 winds up the supplied recording sheet 1*a* while automatically curling it therein. However, as will be described below, as shown in FIGS. 11A to 11C, a recording sheet can be more efficiently and reliably wound up through a wind-up shaft driven by a motor, a bias guide biased therearound, and the like.

Figure 11A:
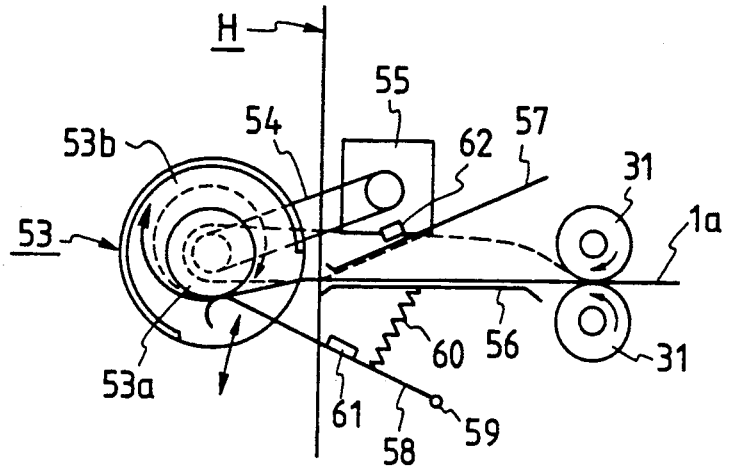
Figure 11B:
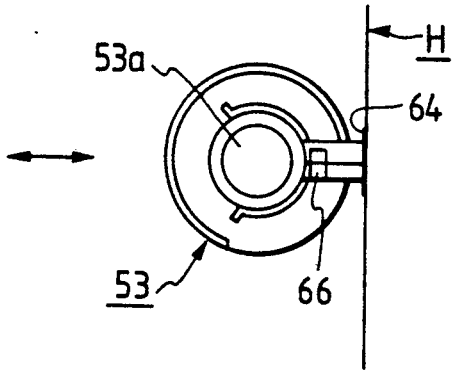
Figure 11C:
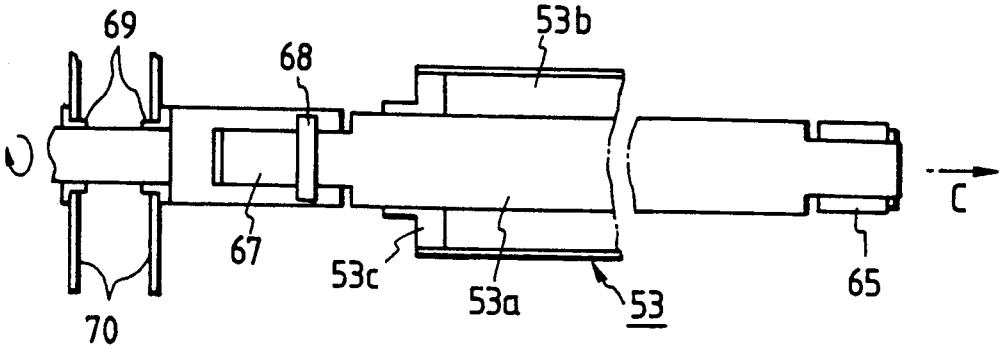

More specifically, FIG. 11A is a cross-sectional view of the main portion of another embodiment, FIG. 11B is a right side view of FIG. 11A, and FIG. 11C is a longitudinal sectional view showing a state wherein a shaft is released.

In FIGS. 11A to 11C, paper exhaust rollers 31 capable of supplying a recording sheet 1*a* in the same manner as in the above embodiments are arranged on a frame H of a main body C. A wind-up shaft 53*a* driven by a motor 55 through a belt 54 is pivotally mounted in a cylindrical wind-up box 53. A wind-up space 53*b* capable of winding up the recording sheet 1*a* is defined between the wind-up shaft 53*a* and the cylindrical wind-up box 53. A horizontal paper exhaust guide 56 is arranged below a portion between the paper exhaust rollers 31 and the wind-up box 53, and an inclined loop guide 57 is arranged thereabove. These components can guide the recording sheet 1*a* exhausted by the paper exhaust rollers 31 into the wind-up box 53. A distal end portion of a bias swingable guide 58 is biased against the outer surface of the wind-up shaft by the biasing force of a spring 60 about a guide shaft 59. A swingable stopper 61 is provided to the swingable guide 58. A microswitch 62 is arranged on the loop guide 57 to detect a loop. A click 64 is fixed to the frame H, and a click bearing 65 is fitted on the wind-up shaft 53*a*. When the wind-up shaft 53*a* is pulled in the direction of the arrow C, the click bearing 65 is disengaged from the clock 64 to be released. A microswitch 66 is arranged to position the wind-up shaft 53*a*. In addition, a fixed rotating shaft 67 is supported by a pair of support plates 60 and a pair of bearings 69. A release shaft 68 is fitted on the wind-up shaft 53*a*. A flange 53*c* is formed on the wind-up box 53.

Therefore, in the case of the device shown in FIGS. 11A to 11C, the recording sheet 1*a* exhausted by the paper exhaust rollers 31 is guided to the wind-up box 53 by the paper exhaust guide 56 and the loop guide 57. When the microswitch is turned on upon detection of the loop, the motor 55 is driven so that the leading end of the recording sheet 1a is brought into tight contact with the outer surface of the wind-up shaft 53 while being pressed by the bias swingable guide 58. Thus, the recording sheet 1a can be automatically and reliably wound up by the wind-up shaft 53a which is pivoted by the motor 55. The wind-up shaft 53a can be pulled in the direction of the arrow C in FIG. 11C. When the click bearing 65 is pushed into the click 64, the wind-up shaft 53a can be mounted in an original state. When the position of the wind-up shaft 53a is shifted, the wind-up shaft positioning microswitch 66 can be operated.

The storing device according to this embodiment comprises an arcuated portion having a sheet entrance. Thus, a recording sheet exhausted from a paper exhaust unit can be stored in the arcuated portion while being wound up. Thus, unlike in the conventional device, no large tray is needed, and hence, a recording sheet exhausted from the paper exhaust unit can be processed in a small storing space. In addition, large and small size recording sheets can be smoothly stored. Unlike in the conventional device, the recording sheet can be prevented from being damaged, bent, and so on. Furthermore, the stored recording sheet can be smoothly taken out, and can be automatically processed even if a user leaves the apparatus.

Figure 12:
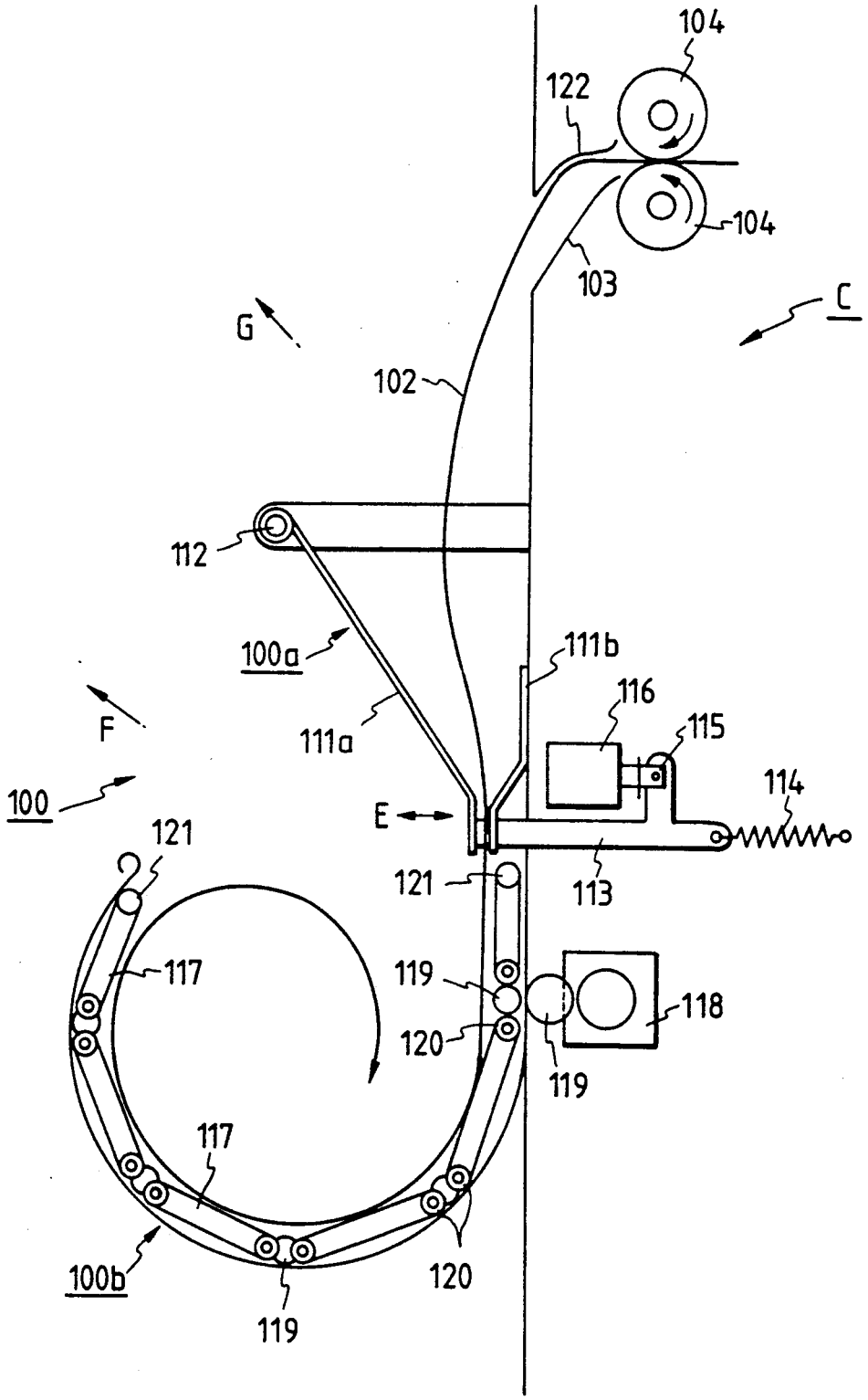

The sheet storing device according to this embodiment can be constituted by a storing device 100 having the structure shown in FIG. 12.

In the storing device 100, upper and lower storing units 100a and 100b are vertically arranged. A large size recording sheet 102 is stored to extend over the upper and lower storing units 100a and 100b. On the other hand, a small size recording sheet 102 is stored in only the upper storing unit 100a.

As shown in FIG. 12, in the upper storing unit 100a of the storing device 100, a movable guide 111a and a guide stopper 111b are disposed in a V shape. The movable guide 111a is moved, in a direction of an arrow E about a guide shaft 112 whose upper end is axially supported, by a swingable plate 113 which is mounted on the lower end of the stopper 111a. Thus, the movable guide 111a is brought into contact with or separated from the guide stopper 111b to open/close the bottom portion of the upper storing unit 100a. The terminal end of the swingable plate 113 is held by a swingable spring 114, and is coupled to a plunger 116 through a coupling shaft 115. Upon operation of the plunger 116, the above-mentioned opening/closing operation is achieved.

The entire lower storing unit 100b is formed into a U shape by belts 117 so as to wind up the recording sheet 102 supplied from the bottom portion of the upper storing unit 100a while curling it in a direction of an arrow in the lower storing unit 100b. As described above, the U-shaped belts 117 can be driven through a motor 118, transmission gears 119, belt transmission drive gears 120, and belt drive rollers 121.

Therefore, in the case of the storing device 100, when a large size recording sheet 102 larger than the A1 size is selected at the operation unit 23, the plunger 116 is operated to move the swingable plate 113 and the lower portion of the movable guide 111a fixed thereto to the left against the biasing force of the swingable spring 114. Thus, the bottom portion of the upper storing unit 110a is opened to form a gap through which the recording sheet 102 passes. Therefore, the recording sheet 102 exhausted by the paper exhaust rollers 104 is introduced into the upper storing unit 100a while being guided by the exhaust tray guide 103 or a floating prevention guide 122, and passes through the gap of the bottom portion by its weight. The sheet 102 is wound while being sequentially curled in the direction of the arrow by a large number of belts 117 driven by the motor 118, as described above. The recording sheet 102 wound up in this manner can be taken out in a direction of an arrow F.

When a small size recording sheet 102 smaller than the A1 size is selected at the operation unit 23, the swingable plate 113 and the lower portion of the movable guide 111a are moved to the right due upon operation of the swingable spring 114. The lower portion of the movable guide 11a is brought into contact with the guide stopper 111b to close the gap of the bottom portion of the upper storing unit 100a. As a result, the small size recording sheet 102 can be stored in the upper storing unit 100a. The recording sheet 102 can be easily taken out in a direction of an arrow G.

As described above, the device according to this embodiment has a wind-up storing unit which can store a large size recording sheet while winding it up, and can store a small size recording sheet in an original state. Therefore, unlike in the conventional device, no large tray is necessary. Thus, a recording sheet exhausted from a paper exhaust unit can be processed in a small storing space. Large and small size recording sheets can be smoothly stored in a common storing device. Therefore, a recording sheet extending outside the tray can be prevented from being damaged or bent unlike in the conventional device. In addition, the stored sheet can be smoothly taken out. In addition, the sheet can be automatically processed even if a user leaves the device.

Figure 13A:
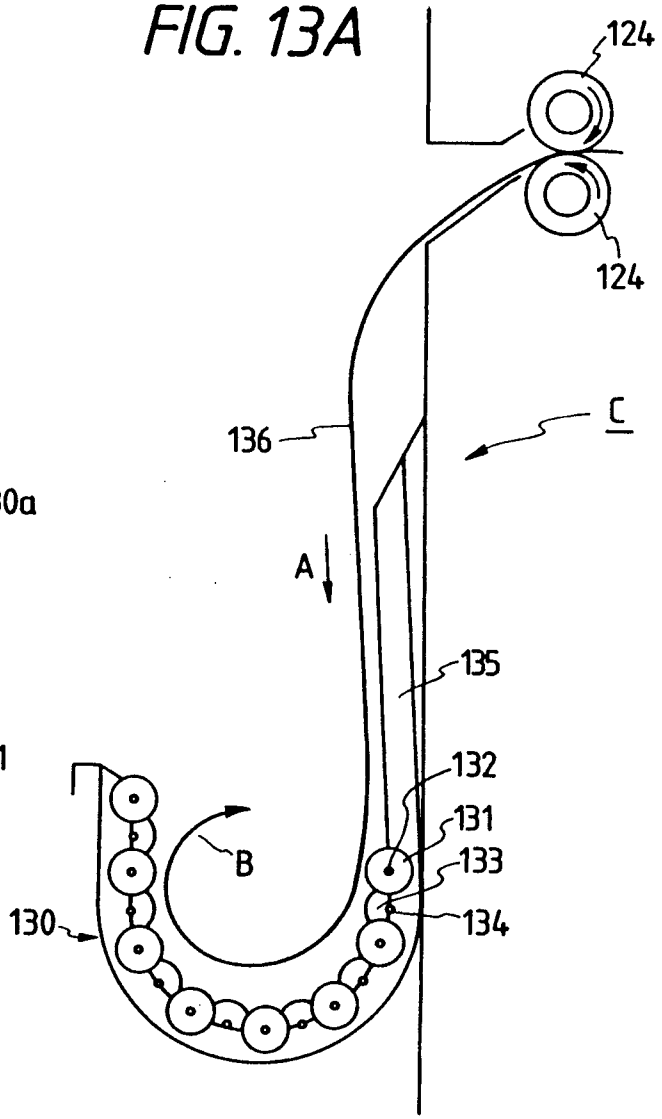
Figure 13B:
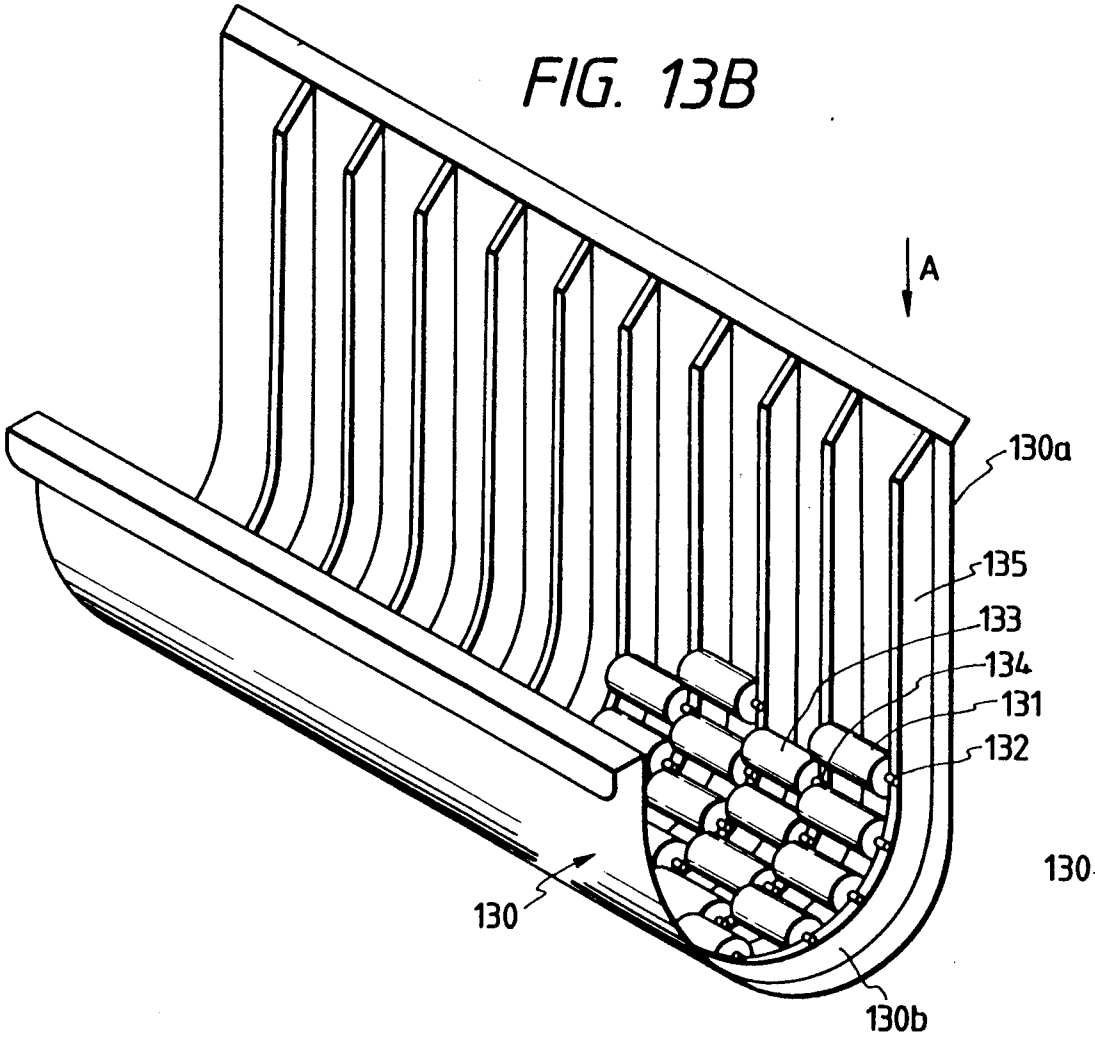

Another embodiment of the present invention will be described hereinafter with reference to FIGS. 13A and 13B.

A sheet wind-up storing device 130 of this embodiment has a substantially "J" shape defined by a vertical portion 130a and an arcuated portion 130b coupled thereto. A plurality of arrays of ribs 135 are provided to the vertical portion 130a and the arcuated portion 130b along the overall width of the sheet convey path. Rollers 131 and 133 are alternately disposed between the adjacent ribs 135 located at the arcuated portion 130b. The rollers 131 and 133 are rotatably arranged on shafts 132 and 134 provided between the adjacent ribs 135. Note that the rollers 131 and 133 are arranged in a direction perpendicular to the recording sheet convey direction over a range slightly larger than the sheet width.

Therefore, the leading end of a recording sheet 136 exhausted from the recording apparatus C by paper exhaust rollers 124 is guided by the ribs 135, and then abuts against the rollers 131 provided to the arcuated portion 130b. Since the rollers 131 are rotatable, the leading end of the recording sheet 136 can smoothly travel, and then abuts against the next rollers 133 The rollers 133 are also rotated in the same manner as the rollers 131 to allow smooth travel of the recording sheet 136. In this manner, the elongate recording sheet 136 can smoothly pass the arcuated portion 130b in the storing device 130, and is wound up while being curled in a direction of an arrow B. According to this embodiment, an elongate recording sheet can be smoothly stored while being wound up.

As described above, according to the present invention, a sheet processing device capable of smoothly processing a recording sheet and an image recording apparatus using the sheet processing device are provided.

What is claimed is:

1. An image recording apparatus for recording an image on a recording sheet, comprising:

roll-like recording sheet holding means for holding a roll of recording sheet material;

cut recording sheet holding means for holding a precut first recording sheet;

cutting means for cutting a second recording sheet from the roll of recording sheet material;

recording means for recording an image on a selected one of the first recording sheet and the second recording sheet;

first size recording sheet receiving means for receiving the selected recording sheet after recording by said recording mans when the selected recording sheet has a first size;

second size recording sheet receiving means for receiving the selected recording sheet after recording by said recording means when the selected recording sheet has a second size different from the first size; and guide means for guiding the selected recording sheet selectively to either said first or second size sheet receiving means in accordance with the size of the selected recording sheet.

2. An apparatus according to claim 1, wherein the first size recording sheet is larger than the second size recording sheet, and said first size recording sheet receiving means receives the selected recording sheet to curl a leading end in a conveying direction of the selected recording sheet.

3. An image recording apparatus according to claim 1, wherein said guide means selectively guides the selected recording sheet in accordance with a recording sheet size determined by a central processing unit.

4. An image recording apparatus according to claim 1, wherein said guide means selectively guides the selected recording sheet in accordance with a recording sheet size determined by a central processing unit in response to inputted original size or magnification.

5. An image recording apparatus according to claim 1, wherein said guide means selectively guides the selected recording sheet in accordance with a recording sheet size inputted by an operator.

6. A recording sheet receiving apparatus capable of attachment to an image recording apparatus for recording an image on a recording sheet, said receiving apparatus comprising:

a recording sheet entering section into which the recording sheet falls; and fixed guide means for curling and guiding a leading end of the recording sheet as it falls thereinto from said recording sheet entering section.

7. An apparatus according to claim 6, wherein said fixed guide means has an arcuate shape.

8. An apparatus according to claim 6, wherein said fixed guide means comprises an openable/closable wind-up box, said wind-up box having an arcuate portion.

9. An apparatus according to claim 6, wherein an end portion of said fixed guide means is arranged such that the received sheet is exposed therefrom, said end portion of said fixed guide means corresponding to a sheet take-out portion.

10. An apparatus according to claim 6, wherein said fixed guide means has a drive wind-up shaft for winding up the recording sheet.

11. An apparatus according to claim 6, further comprising a sheet receiving unit for receiving the recording sheet from said entering section, wherein said sheet receiving unit has a plurality of rotatable rollers allowing a smooth wind-up operation of the recording sheet.

12. A recording sheet receiving apparatus according to claim 6, wherein said recording sheet entering section is provided along a side wall of said image recording apparatus.

13. A recording sheet receiving apparatus according to claim 6, wherein said guide means is arcuately provided with a plurality of rollers capable of idle rotation.

14. A recording sheet receiving apparatus according to claim 6, wherein said guide means is arcuately provided with a plurality of driving rollers.

15. A recording sheet receiving apparatus according to claim 6, wherein exhausting rollers are provided at an exhausting section and said recording sheet passing through said exhausting rollers falls into said recording sheet entering section.

16. A recording sheet receiving apparatus according to claim 6, said apparatus further comprising a member displaceable between a stop position for stopping said recording sheet from entering said recording sheet entering section and a retracted position retracted from said stop position, wherein said member is positioned at said stop position when said recording sheet is of small size.

17. A sheet processing device applicable to an image forming apparatus for recording an image on a recording sheet, comprising:

an elongate sheet loading unit;

a cut sheet loading unit capable of loading a cut sheet which is cut into a predetermined size in advance;

elongate sheet conveying means for conveying an elongate sheet loaded in said elongate sheet loading unit;

cut sheet conveying means for conveying the cut sheet loaded in said cut sheet loading unit;

a sheet wind-up storing unit for winding up and storing the elongate sheet after image recording; and a cut sheet storing unit for storing the cut sheet after image recording.

18. An apparatus according to claim 17, wherein said sheet wind-up storing unit comprises an openable/closable wind-up box, said wind-up box having an arcuate portion.

19. An apparatus according to claim 17, wherein an end portion of said sheet wind-up storing unit is arranged such that the received sheet is exposed therefrom, said end portion of said sheet wind-up storing unit corresponding to a sheet take-out portion.

20. An apparatus according to claim 17, wherein said sheet wind-up storing unit has a drive wind-up shaft for winding up the recording sheet.

21. An exhausted recording sheet processing device applicable to an image recording apparatus for recording an image on a recording sheet, comprising:

a sheet introduction port through which the recording sheet is introduced;

a first sheet receiving unit having an arcuated portion for receiving and winding up the recording sheet introduced from said sheet introduction port; and a second sheet receiving unit for receiving the recording sheet introduced from said sheet introduction port so that a leading end of the recording sheet extends downward.

22. An image recording apparatus for recording an image on a recording sheet, comprising:

recording means for recording the image on said recording sheet;

conveying means for conveying said recording sheet from said recording means;

a recording sheet entering section into which said recording sheet falls; and fixed guide means for curling and guiding a leading end of said recording sheet as it falls thereinto from said recording sheet entering section.

23. An image recording apparatus according to claim 22, wherein said recording sheet is initially provided in a roll, and a winding direction of the recording sheet in the roll is the same as a direction in which said fixed guide means curls said recording sheet.

24. An image recording apparatus according to claim 22, wherein said recording sheet entering section is provided along a side wall of said image recording apparatus.

25. An image recording apparatus according to claim 22, wherein said guide means has an arcuate shape.

26. An image recording apparatus according to claim 22, wherein said guide means is arcuately provided with a plurality of rollers capable of idle rotation.

27. An image recording apparatus according to claim 22, wherein said guide means is arcuately provided with a plurality of driving rollers.

28. An image recording apparatus according to claim 22, wherein exhausting rollers are provided at an exhausting section and said recording sheet passing through said exhausting rollers falls into said recording sheet entering section.

29. An image recording apparatus according to claim 22, said apparatus further comprising a member displaceable between a stop position for stopping said recording sheet from entering said recording sheet entering section and a retracted position retracted from said stop position, wherein said member is positioned at said stop position when said recording sheet is of small size.

* * * * *

UNITED STATES PATENT AND TRADEMARK OFFICE

CERTIFICATE OF CORRECTION

PATENT NO. : 5,012,295

DATED : April 30, 1991

INVENTOR(S) : Masatoshi IKKATAI, ET AL.

It is certified that error appears in the above-identified patent and that said Letters Patent is hereby corrected as shown below:

AT [56] References Cited
U.S. PATENT DOCUMENTS

"Ler Horst" should read --ter Horst--

COLUMN 5:
Line 50, "sheetis" should read --sheet is--.

COLUMN 8:
Line 57, "clock 64" should read --click 64--.

COLUMN 10:
Line 13, "movable guide 11a" should read --movable guide 111a--; and
Line 57, "133 The" should read --133. The--.

COLUMN 11:
Line 17, "recording mans" should read --recording means--.

Signed and Sealed this

Third Day of November, 1992

*Attest:*

DOUGLAS B. COMER

*Attesting Officer*

*Acting Commissioner of Patents and Trademarks*